US007049797B2

(12) United States Patent
Fukui et al.

(10) Patent No.: US 7,049,797 B2
(45) Date of Patent: May 23, 2006

(54) SEMICONDUCTOR INTEGRATED CIRCUIT DEVICE

(75) Inventors: Kenichi Fukui, Kodaira (JP); Mitsuru Hiraki, Kodaira (JP); Takayasu Ito, Higashimurayama (JP); Isao Nakamura, Fussa (JP)

(73) Assignees: Renesas Technology Corp., Tokyo (JP); Renesas Northern Japan Semiconductor, Inc., Hokkaido (JP)

( * ) Notice: Subject to any disclaimer, the term of this patent is extended or adjusted under 35 U.S.C. 154(b) by 219 days.

(21) Appl. No.: 10/676,605

(22) Filed: Oct. 2, 2003

(65) Prior Publication Data

US 2004/0155636 A1 Aug. 12, 2004

(30) Foreign Application Priority Data

Oct. 11, 2002 (JP) ..... 2002-299469

(51) Int. Cl.
*G05F 1/40* (2006.01)
*G05F 1/10* (2006.01)

(52) U.S. Cl. ..... 323/281; 327/538

(58) Field of Classification Search ..... 323/274, 323/280, 281, 312, 313, 314; 327/535, 538, 327/539, 544, 545
See application file for complete search history.

(56) References Cited

U.S. PATENT DOCUMENTS

| | | | | |
|---|---|---|---|---|
| 5,410,507 A | | 4/1995 | Tazunoki et al. | 365/189.09 |
| 5,563,837 A | * | 10/1996 | Noguchi | 365/222 |
| 5,862,096 A | | 1/1999 | Yasuda et al. | 365/229 |
| 6,034,519 A | * | 3/2000 | Yang | 323/316 |
| 6,194,887 B1 | * | 2/2001 | Tsukada | 323/315 |
| 6,236,194 B1 | | 5/2001 | Manabe et al. | 323/274 |
| 6,329,873 B1 | * | 12/2001 | Morishita | 327/541 |
| 6,791,308 B1 | * | 9/2004 | Shim | 323/314 |
| 6,861,872 B1 | * | 3/2005 | Suh | 326/62 |
| 6,885,235 B1 | * | 4/2005 | Tomishima et al. | 327/538 |
| 6,903,601 B1 | * | 6/2005 | Aude | 327/541 |
| 2002/0003449 A1 | | 1/2002 | Kato | 327/540 |
| 2003/0034823 A1 | | 2/2003 | Hiraki et al. | 327/334 |

FOREIGN PATENT DOCUMENTS

| | | |
|---|---|---|
| JP | 5-198165 | 8/1993 |
| JP | 10-74394 | 3/1998 |
| JP | 2001-117650 | 4/2001 |
| JP | 2001-211640 | 8/2001 |
| JP | 2001-222331 | 8/2001 |
| JP | 2002-26260 | 1/2002 |

* cited by examiner

*Primary Examiner*—Matthew V. Nguyen
(74) *Attorney, Agent, or Firm*—Antonelli, Terry, Stout and Kraus, LLP.

(57) ABSTRACT

In a semiconductor integrated circuit device, having a pair of voltage step-down power supply circuits for active and standby conditions, a first reference voltage is formed by amplifying a fixed voltage formed in a fixed voltage generating circuit with an amplifying circuit which can adjust the voltage gain having a resistance circuit and a switch controlled with a first trimming switch setting signal. An internal step-down voltage, when the internal circuit is in the active condition, is outputted from a first output buffer, which is activated with a first control signal. A second reference voltage is formed by adjusting a combination of threshold voltages of MOSFETs and a switch controlled with a second trimming switch setting signal; and, an internal step-down voltage, when the internal circuit is in the standby condition, is outputted with a second output buffer, which is activated with a second control signal.

16 Claims, 13 Drawing Sheets

SEMICONDUCTOR INTEGRATED CIRCUIT DEVICE

BACKGROUND OF THE INVENTION

The present invention relates to a semiconductor integrated circuit device; and, more specifically, the invention relates to a technique which is applicable to a voltage step-down power supply circuit, for example, of the type used in a one-chip microcomputer.

The following documents have been reported as disclosing examples of a semiconductor integrated circuit device including an internal voltage step-down power supply circuit. The Japanese Published Unexamined Patent Application No. 117650/2001 (hereinafter referred to as the document 1) indicates that power consumption in the standby operation can be lowered by using a first internal voltage step-down circuit for an active operation, which exhibits a large current consumption, but assures an excellent response characteristic, and a second internal voltage step-down circuit for a standby operation, which has inferior response characteristic, but exhibits a small current consumption through the switching operation. The document, "A tunable CMOS-DRAM Voltage Limiter with Stabilized Feedback Amplifier", IEEE J. SOLID-STATE CIRCUITS, Vol. 25, No. 5, October 1990 (hereinafter referred to as the document 2) describes voltage trimming through switching of the serial/parallel conditions of a MOSFET.

[Document 1]

Japanese Published Unexamined Patent Application No. 117650/2001

[Document 2]

"A tunable CMOS-DRAM Voltage Limiter with Stabilized Feedback Amplifier", JEEE J. SOLID-STATE CIRCUIT, Vol. 25, No. 5, October 1990

SUMMARY OF THE INVENTION

The inventors of the present invention have considered reduction of the standby current in a semiconductor integrated circuit device that is mounted in a CPU (microprocessor) up to about 1 μA. As a result, the inventors have found that a high resistance must be used in order to realize low power consumption, as described above, in the voltage step-down power supply circuit for standby use; such as discussed in document 1; and, they also have encountered the problem that, when such a high resistance is formed on a semiconductor substrate, the resistance element that is employed requires a huge installation area. Therefore, it has been attempted to form a voltage step-down power supply circuit using the circuit including the MOSFET described in the aforementioned document 2, but it is also apparent that this circuit structure has a problem in that the temperature characteristic is left unsolved when the voltage is adjusted by trimming or the like, and, thereby, the accuracy is lowered.

Moreover, in a semiconductor integrated circuit device, such as the conventional DRAM, in which a standby current as high as 100 μA or more flows, it is assumed that a particular problem does not occur. However, in a device having various circuit functions, such as a system LSI, where the CPU and its peripheral circuits are mounted to only one semiconductor integrated circuit device, it has been established that, when the structure where the reference power supply circuit for an active condition is stopped in order to reduce the current in the standby operation, the reference power supply circuit for the active condition must be re-started when switching from the standby condition is switched to the active condition, so that a longer time is required until the internal voltage reaches a predetermined stable voltage condition, an error is generated in the operation when the internal circuit, such as the CPU, is operated simultaneously with the switching to the active condition, or particular attention must be paid to operation of the voltage step-down power supply circuit in order to realize automatic trimming of the voltage step-down by the CPU.

It is an object of the present invention to provide a semiconductor integrated circuit device including a voltage step-down power supply circuit which exhibits high performance and low power consumption even when the installation area is reduced.

Another object of the present invention is to provide a semiconductor integrated circuit device in which automatic voltage adjustment of two voltage step-down power supply circuits for the active condition and the standby condition, respectively, is accomplished.

The aforementioned and the other objects and novel features of the present invention will become more apparent from the description provided in the present specification and from the accompanying drawings.

Typical aspects of the invention disclosed in the present specification will be briefly summarized as follows.

A first reference voltage is formed by amplifying a fixed voltage that has been generated by a fixed voltage generating circuit using an amplifying circuit with a voltage gain that is adjusted using a resistance circuit and a switch controlled by a first trimming switch setting signal. A first output buffer, which is activated by a first control signal, outputs an internal step-down voltage when the internal circuit is in the active condition. A second reference voltage is formed by adjusting the combination of the threshold value voltages of MOSFETs with a plurality of MOSFETs and a switch controlled with a second trimming switch setting signal, and an internal voltage step-down in the standby condition of an internal circuit is outputted from a second output buffer, which is activated by a second control signal.

DETAILED DESCRIPTION OF THE PREFERRED EMBODIMENTS

Figure 1:
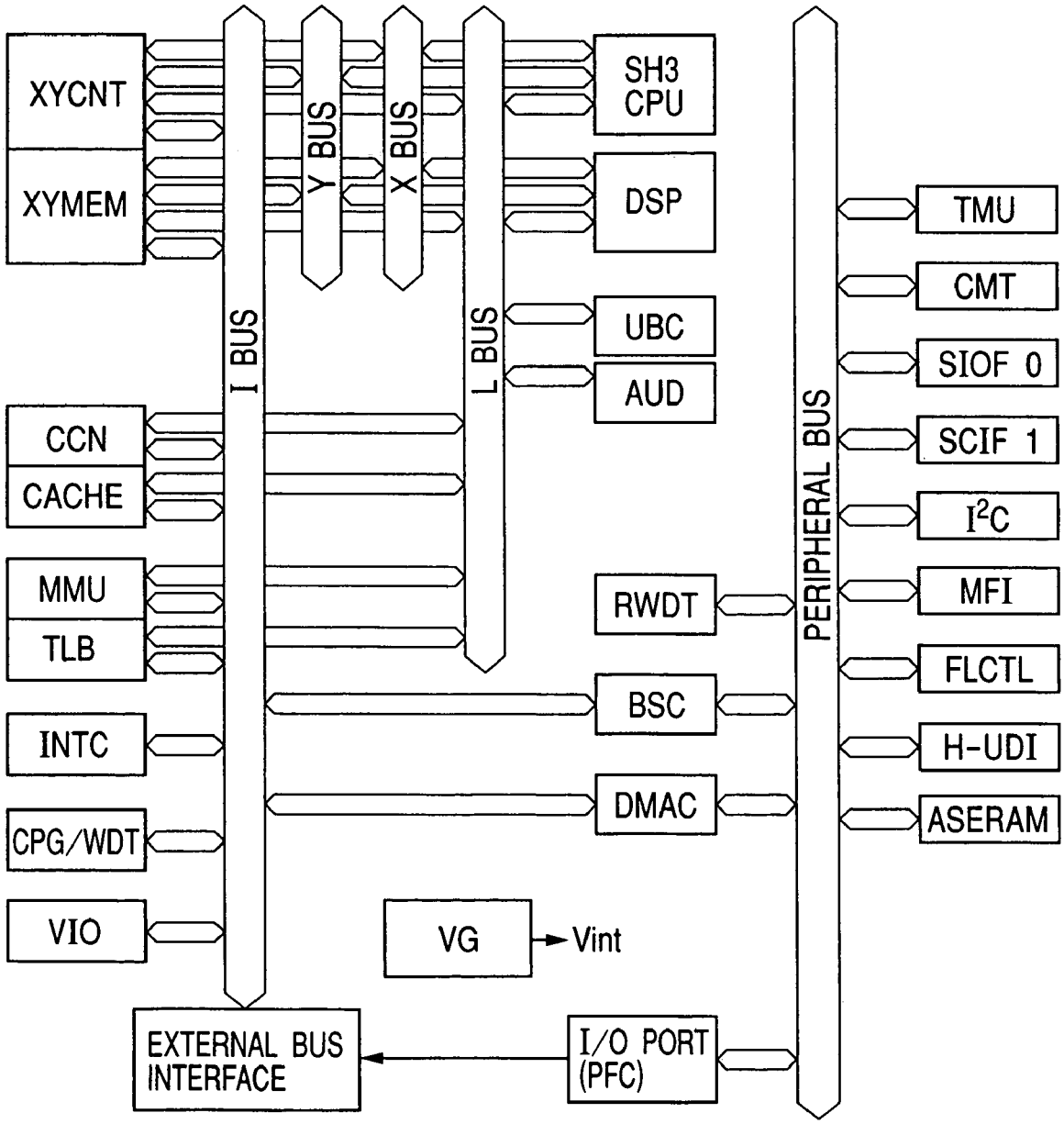
FIG. 1 is a block diagram showing an embodiment of a microcomputer LSI to which the present invention is applied.

FIG. 1 is a block diagram of an embodiment of a microcomputer LSI to which the present invention is applied. Each circuit block of this figure is formed on a single substrate, such as a single crystal silicon substrate, using the well known CMOS (complementary MOS) semiconductor integrated circuit manufacturing technology.

The microcomputer LSI described above is intended, although the invention is not particularly so restricted, to application into mobile devices which carry out high performance arithmetic processes and integrated peripheral units of the type required for system configuration by introducing a RISC (Reduced instruction set computer) type central processing unit CPU. The CPU has a RISC type instruction set, and the basic instruction operates on a one instruction and one state (one system clock cycle) basis through a pipeline process. Following peripheral circuits are also mounted around the CPU and data signal processor DSP, for example, to form a mobile telephone.

An internal bus is composed of an I bus, Y bus, X bus, L bus and peripheral bus, and a memory XYMEM and a memory controller XYCNT for image process are also provided as built-in peripheral modules to form a user system with the minimum number of components. The memory XYMEM and controller XYCNT are connected to the I bus, X, Y buses and L bus, and the data output operation is executed for a data input/output and a display operation for an image process.

The I bus described above is provided with a cache memory CACHE, a cache memory controller CCN, a memory management controller MMU, a translation look-aside buffer TLB, an interruption controller INTC, a clock oscillator/watch-dog timer CPG/WDT, a video I/O module VIO and an external bus interface. These elements are connected to an external memory LSI or the like (not illustrated) via this external bus interface.

The L bus is connected to the cache memory CACHE, the cache memory controller CCN, the memory management controller MMU, the translation look-aside buffer TLB, a central processing unit CPU, a data signal processor DSP, a user break controller UBC and an advanced user debugger AUD.

The peripheral bus described above is connected to a timer unit TMU of 16 bits, a compare match timer CMT, a serial I/O (with FIFO) SIOF0, a serial communication interface SCIF1 with built-in FIFO, a $I^2C$ controller $I^2C$, a multi-function interface MFI, a NAND/AND flash interface FLCTL, a user debug interface H-UDI, an ASE memory ASERAM, a pin function controller PFC, a RCLK operation watch dog timer RWDT. The peripheral bus and I bus are also connected with a bus state controller BSC and a direct memory access controller DMAC.

The power supply circuit VG receives a comparatively higher external voltage, which is as high as 3.0V, for example, supplied from an external terminal, forms a step-down voltage as low as 1.4V to 1.6V when the internal circuit of the CPU or the like is in the active condition, and also forms a step-down voltage as low as 1.3 to 1.7V when the internal circuit of the CPU or the like is in the standby condition. Such step-down voltages are supplied as operation voltages to each interval circuit, as described above. However, the external bus interface includes an input circuit, an output circuit and a level converting circuit for sending and receiving a signal level corresponding to the external voltage of about 3V, and the input circuit, output circuit and level converting circuit are supplied with an external voltage in place of the step-down voltages described above.

Figure 2:
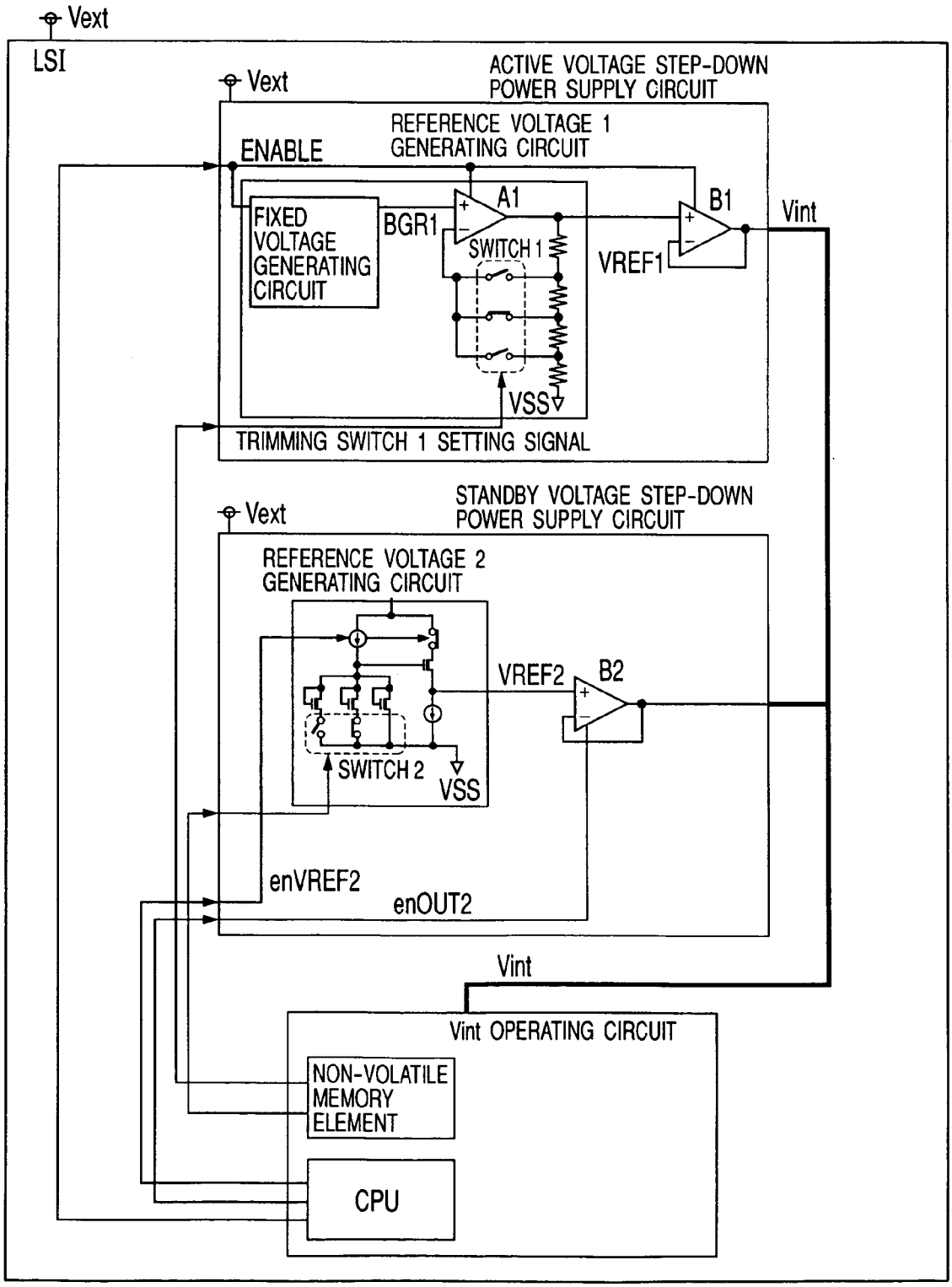
FIG. 2 is a block diagram showing an embodiment of the power supply circuit VG of FIG. 1.

FIG. 2 illustrates a block diagram of an embodiment of the power supply circuit VG. The power supply circuit VG is formed of a voltage step-down power supply circuit for an active condition and a voltage step-down power supply circuit for a standby condition. The voltage step-down power supply circuits for active and standby conditions receive an external power supply voltage Vext, which is supplied to the semiconductor integrated circuit device LSI, and they form an internal voltage Vint, which is supplied to the CPU and an internal circuit including a non-volatile storage element.

The voltage step-down power supply circuit for an active condition amplifies the current to form the internal voltage Vint using a band-gap type fixed voltage generating circuit, a reference voltage 1 generating circuit to form the reference voltage VREF1 by switching a trimming switch for a voltage dividing ratio of resistance with a trimming switch 1 setting signal, and an output buffer B1 consisting of a voltage follower type amplifying circuit connected to receive the reference voltage VREF1. Namely, the band-gap type fixed voltage generating circuit generates a temperature-compensated fixed voltage BGR1. The reference voltage 1 generating circuit amplifies the fixed voltage BGR1 up to the reference voltage VREF1 in the range, for example, of 1.4V to 1.6V as required for the active condition by adjusting the voltage gain of the amplifying circuit A1 through the switching of the switch 1 for the voltage dividing ratio of resistance in response to the trimming switch 1 setting signal. Each circuit forming the voltage step-down power supply circuit for the active condition is selectively activated by a control signal (enable 1) generated from the CPU.

The voltage step-down power supply circuit for the standby condition forms the internal voltage Vint, for setting the predetermined step-down voltage while the power consumption is reduced, by amplifying the current using the reference voltage 2 generating circuit to form the reference voltage VREF2 by switching of the trimming switch for the connection of a MOSFET in the threshold voltage difference type reference voltage generating circuit of the MOSFET in response to the trimming switch 2 setting signal. The output buffer B2, consisting of the voltage follower type amplifying circuit, is connected to receive such reference voltage VREF2. This reference voltage 2 generating circuit generates the reference voltage VREF2, for example, such as 1.3V to 1.7V, which is required in the standby condition, by switching of the switch 2 for the connection of the MOSFET in response to the trimming switch 2 setting signal. The reference voltage 2 generating circuit and output buffer B2 forming the voltage step-down power supply circuit for active condition is selectively activated by the control signals enVREF2 and enOUT2.

When the internal circuit (Vint operating circuit) of the semiconductor integrated circuit device LSI is in the active condition, each circuit of the voltage step-down power supply circuit for the active condition is activated by the control signal (enable 1). In this case, the output buffer 2 of the voltage step-down supply circuit for the standby condition is non-activated due to the state of control signal enOUT2. Accordingly, the internal circuit (Vint operating circuit) is operated using the internal voltage Vint formed by the voltage step-down power supply circuit for the active condition. The reference voltage 2 generating circuit of the voltage step-down power supply circuit for the standby condition also may be placed in a non-activated state like the output buffer B2 by the control signal enVREF2, but the reference voltage 2 generating circuit may be maintained in the active condition because the current flowing through the reference voltage 2 generating circuit itself is sufficiently small that it can be neglected in comparison with the current consumed in the overall circuits of the semiconductor integrated circuit device in the active condition. Moreover, when such current is maintained in the active condition, it will result in the advantage that the switching time to the standby condition from the active condition can be reduced. Therefore, the control signal enVREF2 is fixed to the active level or it may be eliminated.

When the internal circuit (Vint operating circuit) of the semiconductor integrated circuit device is switched to the standby condition, each circuit of the voltage step-down power supply circuit for the active condition is placed in a non-activated state due to the control signal (enable 1). Namely, a DC current is stopped from flowing into the fixed voltage generating circuit forming the voltage step-down power supply circuit for the active condition, including the amplifying circuit A1 and the trimming resistance of the reference voltage 1 generating circuit and the output buffer B1. The output buffer 2 is activated by the control signal enOUT2, and the internal voltage Vint corresponding to the reference voltage VREF2 formed by the reference voltage 2 generating circuit of the voltage step-down power supply circuit for the standby condition is supplied to the internal circuit (Vint operating circuit). In the standby condition of the internal circuit, almost all operations of the internal circuits in the AC operation are stopped due to the stopping of the supply of the clock, and a holding current of DC level mainly flows.

Since operations of the internal circuit are stopped, the current consumed in this period becomes a leakage current flowing into the MOSFET or the like, and the internal circuit holds the storing condition of the storage circuit, such as a register and a latch circuit with the voltage step-down power supply circuit for the standby condition. Accordingly, the current consumed in the semiconductor integrated circuit device LSI in the standby condition becomes the current consumed in the voltage step-down power supply circuit for the standby condition and the leakage current flowing into the internal circuit. Therefore, the current consumption in the standby condition can be reduced up to about 1 μA by lowering the current consumed in the voltage step-down power supply circuit for the standby condition, which will be described later.

Figure 3:
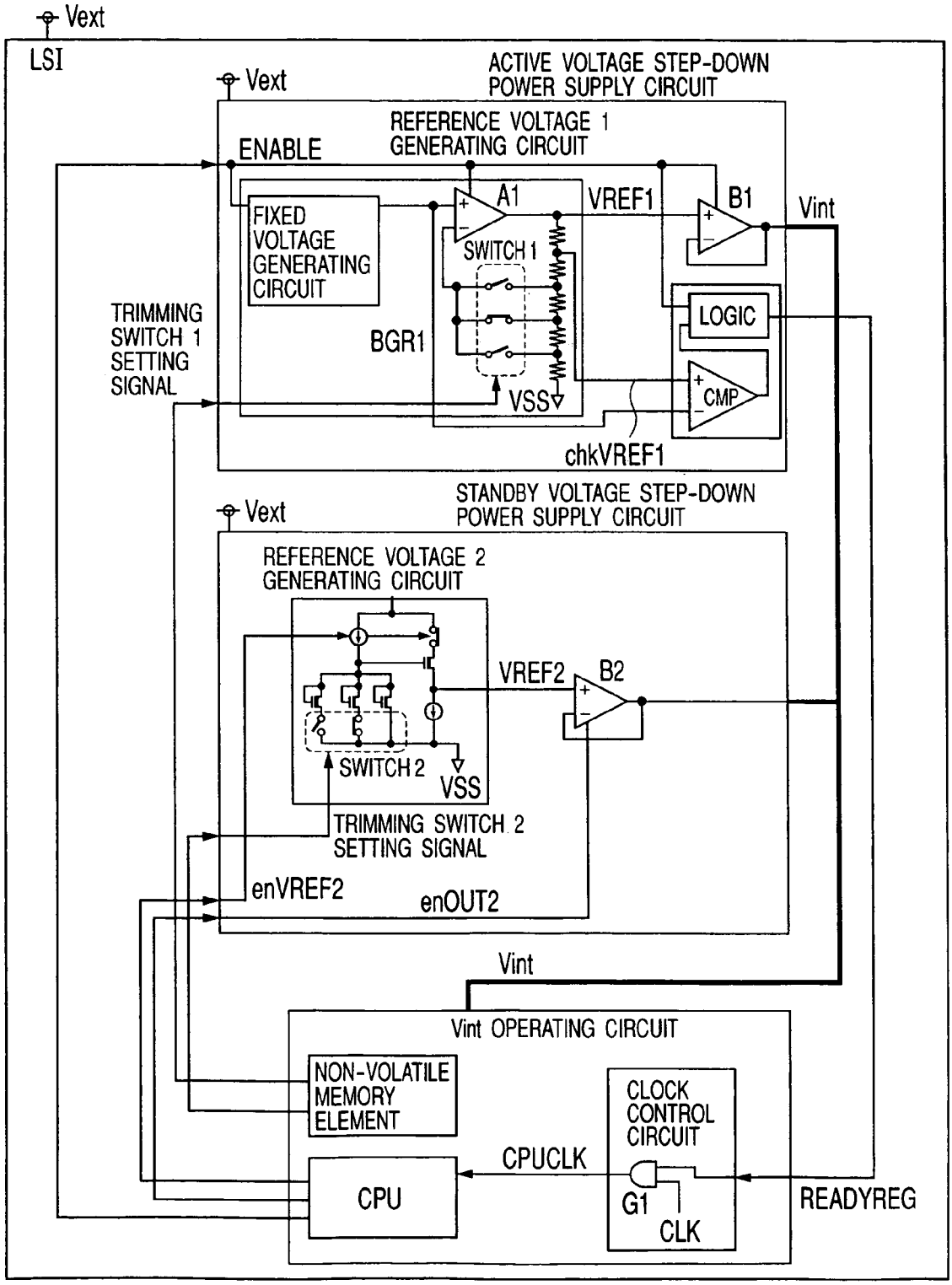
FIG. 3 is a block diagram showing another embodiment of the power supply circuit VG of FIG. 1.

FIG. 3 is a block diagram of another embodiment of the power supply circuit VG of FIG. 1. In this embodiment, the operations of all circuits of the voltage step-down power supply circuit for the active condition, including the fixed voltage generating circuit, are stopped to reduce the power consumption in the standby condition. Therefore, a longer time is required until the operation of the voltage step-down power supply circuit for the active condition is stabilized when switching from the standby condition to the active condition. When the internal circuit, such as the CPU or the like, operates before the operation of the voltage step-down power supply circuit for the active condition is stabilized, the internal voltage Vint is remarkably reduced due to the shortage of current supplied from the voltage step-down power supply circuit for the active condition, and thereby erroneous operation may be generated.

In this embodiment, a voltage detecting circuit consisting of a comparator CMP and a logic circuit is provided in the voltage step-down power supply circuit for the active condition. The comparator CMP receives, at the reversed input (negative) thereof, the fixed voltage BGR1 formed in the fixed voltage generating circuit, and it also receives, at the non-reversed input (positive) thereof, a predetermined divided voltage of the voltage dividing resistance. The divided voltage is selected at a potential which is higher than the fixed voltage BGR1 under the condition that the reference voltage 1 generating circuit is in a stabilized operation.

Accordingly, since the fixed voltage BGR1 is higher than the divided voltage, in the initial condition that the voltage step-down power supply circuit for the active condition is activated by the control signal (enable 1), the comparator CMP forms an output signal of low level. When the reference voltage 1 generating circuit is almost stabilized in operation, the divided voltage becomes higher than the fixed voltage BGR1 and the comparator CMP forms an output signal of high level. The logic circuit delays this output signal so as to generate the control signal READYREG.

The control signal READYREG is used as the control signal of a gate circuit G1 of the clock control circuit provided in the internal circuit. With the control signal READYREG, the gate circuit G1 opens the gate and supplies the clock CLK to the CPU. Accordingly, the CPU is once set to the active condition with the control signal (enable 1) and operates by receiving the supply of the clock CPUCLK corresponding to the control signal READYREG formed by delaying the output signal of the comparator, which has changed to the high level. Thereby, the erroneous operation as described above can be prevented.

Figure 4:
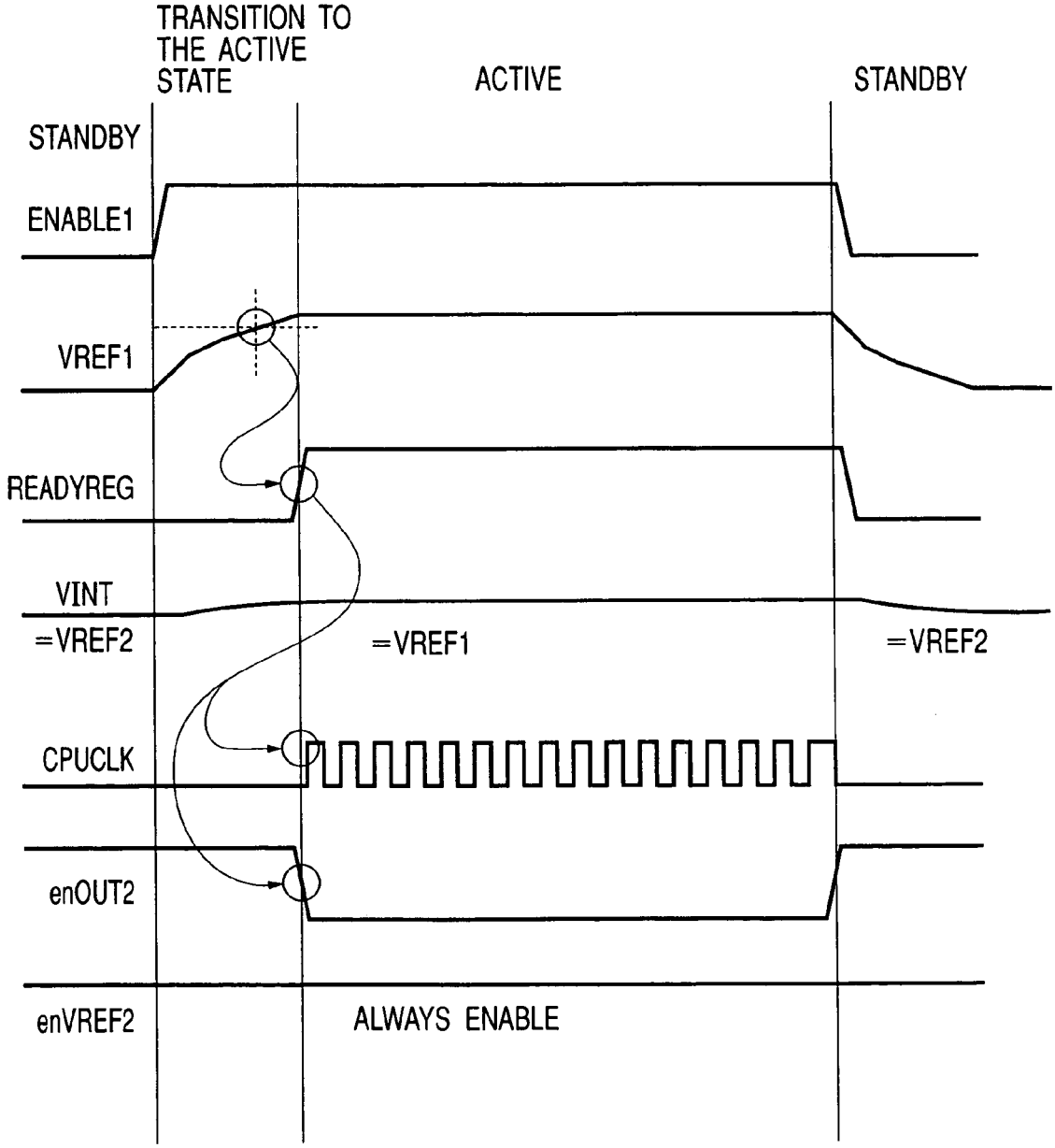
FIG. 4 is a waveform diagram which illustrates an example of the operations of the power supply circuit in relation to the present invention.

FIG. 4 is a waveform diagram showing an example of the operations of the power supply circuit in relation to the present invention. In this figure, the signal waveforms reflect the condition in which the standby condition is switched to the active condition and this active condition is switched again to the standby condition. First, the control signal (enable 1) used to drive the voltage step-down power supply circuit for the active condition rises. Thereby, each circuit of the voltage step-down power supply circuit for active condition is activated, and the fixed voltage BGR1 and the reference voltage VREF1 rise sequentially in this order.

Initially, the internal voltage Vint is by with the output buffer B1 for the standby condition. During the period where the standby condition is switched to the active condition, the output buffer B1 for the active condition and the output buffer B2 for the standby condition are operating simultaneously. Since buffers having a higher supply capability in the PMOS side are used for the two buffers, the output buffer B2 for the standby condition in the higher voltage holds the internal voltage Vint. Accordingly, a voltage drop due to collision of output voltages does not occur. As the reference voltage VREF1 rises, an output voltage from the output buffer B1 for the active condition rises, but since the internal voltage Vint is held to the higher level with the output buffer for the standby condition under the condition that a load current is rather light, a change of the internal voltage Vint cannot be seen initially.

The comparator CMP judges the rise of the reference voltage VREF1 by dividing the reference voltage VREF1 and then comparing, under the normal condition, the divided voltage chkVREF1, which is a littler higher than the fixed voltage BGR1, with the fixed voltage BGR1 and sets the control signal READYREG to the high level (logic 1) with the logic circuit. Thereby, the gate G1 of the clock control circuit opens, the supply of clock CPUCLK to the CPU can be started, the control signal enOUT supplied to the output buffer B2 of the voltage step-down power supply circuit for the standby condition is changed to the low level, and the output buffer B2 is set to the non-active condition. Accordingly, the internal voltage VINT (=Vint) under the active condition is set to the voltage (VINT=VREF1) corresponding to the reference voltage VREF1.

Even in the active condition, as described above, the control signal enREF2 is set in the high level (always enable condition) and the reference voltage 2 generating circuit maintains the activated condition. Therefore, the reference voltage 2 generating circuit forms the reference voltage VREF2, but since the output buffer B2 is in the non-active condition (output high impedance condition), the internal voltage VINT corresponds to the reference voltage VREF1.

Switching to the standby condition from the active condition is instructed, although the invention is not particularly so restricted, by the CPU, and the control signal (enable 1) rises in this timing. Accordingly, each circuit of the voltage step-down power supply circuit for the active condition is non-activated, and, thereby, the READYREG signal generating circuit, consisting of the comparator CMP and logic circuit, sets the control signal READYREG to the low level (logic 0). Thereby, the gate G1 of the clock control circuit closes so as to stop the clock CPUCLK for the CPU and set the CPU to the standby or sleeping condition. Moreover, it is even more preferable when the control signal enOUT is set to the high level before the control signal (enable 1), and, thereby, the output buffer B2 is activated. Accordingly, the internal voltage VINT (=Vint) under the standby condition is set to the voltage (VINT=VREF2) corresponding to the reference voltage VREF2.

Switching to the active condition from the standby condition is realized by raising the control signal (enable 1) by inputting an interruption signal to the CPU or by first setting only a timer circuit in the CPU to the operating condition and then, after passage of the constant period, raising the control signal (enable 1). Moreover, it is also possible to raise the control signal (enable 1) with an external signal.

Figure 5:
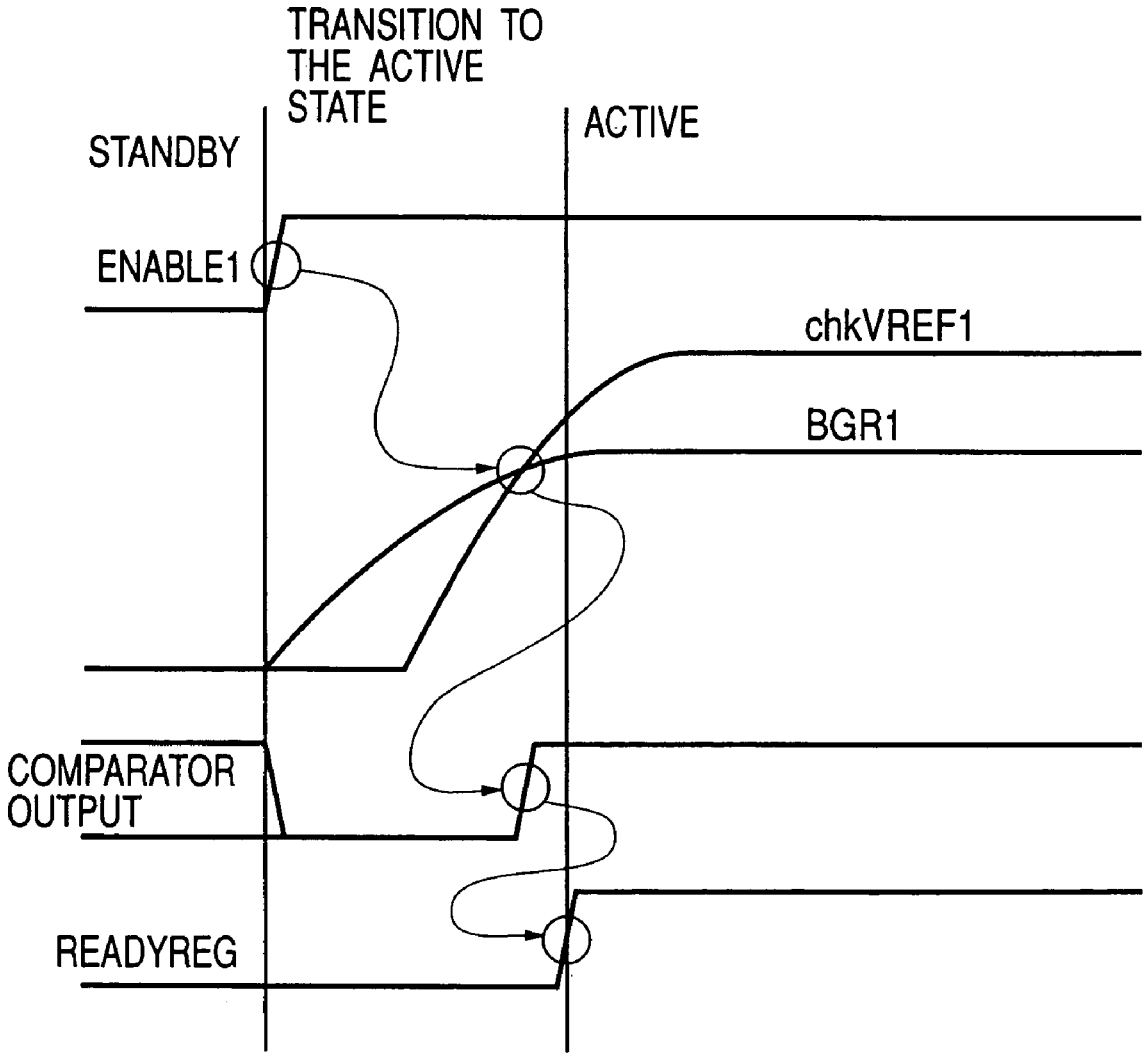
FIG. 5 is a waveform diagram which illustrates an example of the operations of the READYREG signal generating circuit of FIG. 3.

FIG. 5 is a waveform diagram showing an example of operations of the READYREG signal generating circuit of FIG. 3. The voltage chkVREF1 is a divided voltage of the reference voltage VREF1, and it is selected, in the normal condition, according to the voltage which is higher than the fixed voltage BGR1. Accordingly, immediately after the control signal (enable 1) described above has changed to the high level, the voltage BGR1 is higher than the chkVREF1 (BGR1>chkREF1). But, when the operation is almost stabilized due to the amplifying operation in the reference voltage 1 generating circuit, the above-referenced relationship is inverted (BGR1<chkVREF1). The comparator detects this condition and then changes the output signal to the high level from the low level. This output signal is delayed by the logic and the control signal ERADYREG is then changed to the high level from the low level.

Figure 6:
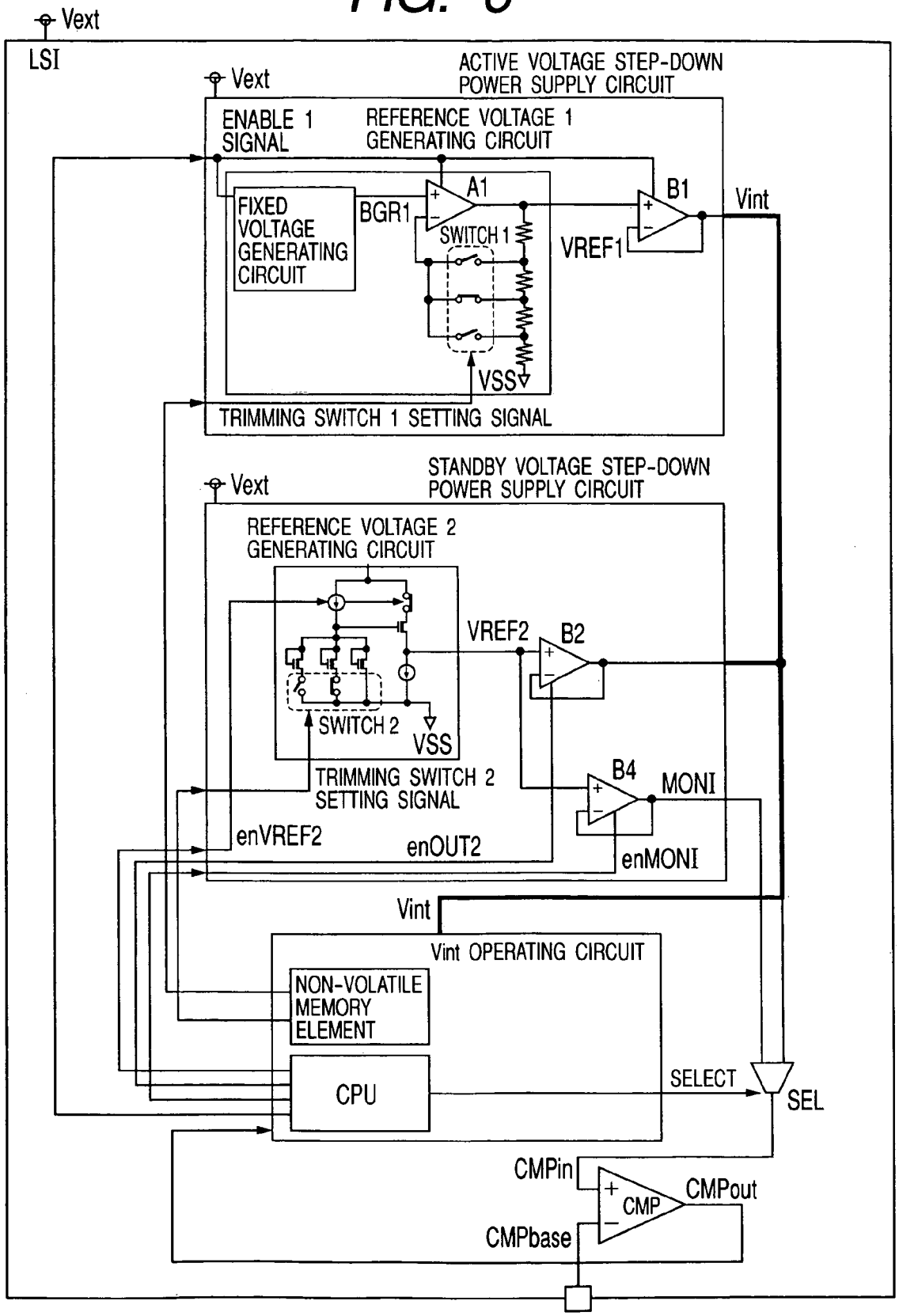
FIG. 6 is a block diagram showing another embodiment of the power supply circuit VG of FIG. 1.

FIG. 6 is a block diagram of another embodiment of the power supply circuit VG of FIG. 1. In this embodiment, the semiconductor integrated circuit device itself includes the voltage step-down power supply circuit for the standby condition which performs automatic trimming adjustment. In this embodiment, as the operation condition of the semiconductor integrated circuit device, the mode of "trimming of reference voltage for active/standby condition" is also provided in addition to the switching of the active/standby condition. Accordingly, the output buffer B4 for monitoring the reference voltage VREF2, as well as a voltage selector SEL and comparator CMP, are added.

Although the invention is not particularly so restricted, a voltage to be set is impressed from an external terminal to the reversed input (negative) of the comparator CMP, while the reference internal voltage Vint from the selector SEL, or a monitor voltage MON1 of the output buffer B4, is impressed to the non-reversed input (positive) thereof. The output buffer B4 is selectively activated by the control signal enMON1, which is provided independently from the output buffer B2.

For example, in order to set the internal voltage Vint to 1.4 to 1.6V in the active condition and to 1.3 to 1.7V in the standby condition, the center voltage of these voltages 1.5V is supplied to the external terminal. In the trimming mode of the reference voltage for the active condition, the CPU raises the control signal (enable 1) to set the semiconductor integrated circuit device to the active condition, selects the internal voltage Vint corresponding to the reference voltage VREF1 using the selector SEL, and supplies this internal voltage Vint to the comparator CMP as the input signal CMPin. The comparator CMP compares this input signal with the reference voltage, such as 1.5V, and transfers the comparison result CMPout to the internal circuit, such as the CPU or the like.

For example, as the trimming sequence, a voltage dividing ratio of the reference voltage 1 generating circuit is set to the minimum value and the switch 1 is then changed over to sequentially increase the voltage gain. When the reference voltage VREF1 is sequentially increased with the switching of the switch 1 and the comparison result CMPout of the comparator CMP has changed to the high level from the low level, or when just preceding the trimming switch 1 setting signal, namely the internal voltage Vint becomes nearest to 1.5V, the trimming switch 1 setting signal is detected and it is then stored in the non-volatile storage element. Thereafter, the trimming switch 1 setting signal stored in the non-volatile storage element is stored in a resister or the like in order to form the control signal of the switch 1.

In the trimming mode of the reference voltage for the standby condition, the control signal (enable 1) is kept raised using the CPU, unlike the standby condition described above, to continuously set the semiconductor integrated circuit device in the active condition. Accordingly, the output buffer B4 is activated by the control signal enMON1. Namely, in the standby condition, as described above, the operation of the internal circuit is stopped and the operations in the trimming mode for the active condition can no longer be executed.

In this embodiment, since the control signal (enable 1) is kept raised to set the semiconductor integrated circuit device in the active condition, the internal voltage MON1 corresponding to the reference voltage VREF2 is selected by the selector SEL and it may be supplied as the input signal CMPin of the comparator CMP. This comparator CMP compares the reference voltage CMPbase, such as 1.5V, and transfers the comparison result CMPout to the internal circuit such as the CMP or the like.

As the trimming sequence in the standby condition, like that in the active condition, an output voltage of the reference voltage 2 generating circuit is set to the minimum value, the reference voltage VREF2 is sequentially raised through the switching of the switch 2, when the comparison result CMPout of the comparator CMP is changed to the high level from the low level or when the just preceding trimming switch 2 setting signal, namely the internal voltage MON1 becomes nearest to 1.5V, the combination of the trimming switch 2 setting signal is detected and it is then stored in the non-volatile storage element. Thereafter, the control signal of the switch 2 can be formed by previously storing the trimming switch 2 setting signal that is stored in the non-volatile storage element to a register or the like.

In this structure, the time occupied by a single tester can be reduced in order to reduce the cost required for testing by increasing the number of simultaneous measuring circuits per tester. Namely, a plurality of semiconductor integrated circuit devices are connected in parallel to the tester and the reference voltage CMPbase is supplied thereto. Accordingly the trimming of a plurality of semiconductor integrated circuit devices can be performed simultaneously in parallel during the testing operation.

The comparator CMP for comparing the signal MON1 of the monitor terminal with the reference voltage (CMPbase) and the circuit for determining the new trimming data by judging the comparison result of the comparator CMP may be realized with an exclusive circuit which is formed of a random logic or the like in addition to the CPU. The trimming data can also be written into the non-volatile storage element with a similar signal route. This non-volatile element can use the circuit included in the power supply circuit VG or the non-volatile storage circuit mounted to the semiconductor integrated circuit device LSI.

Figure 7:
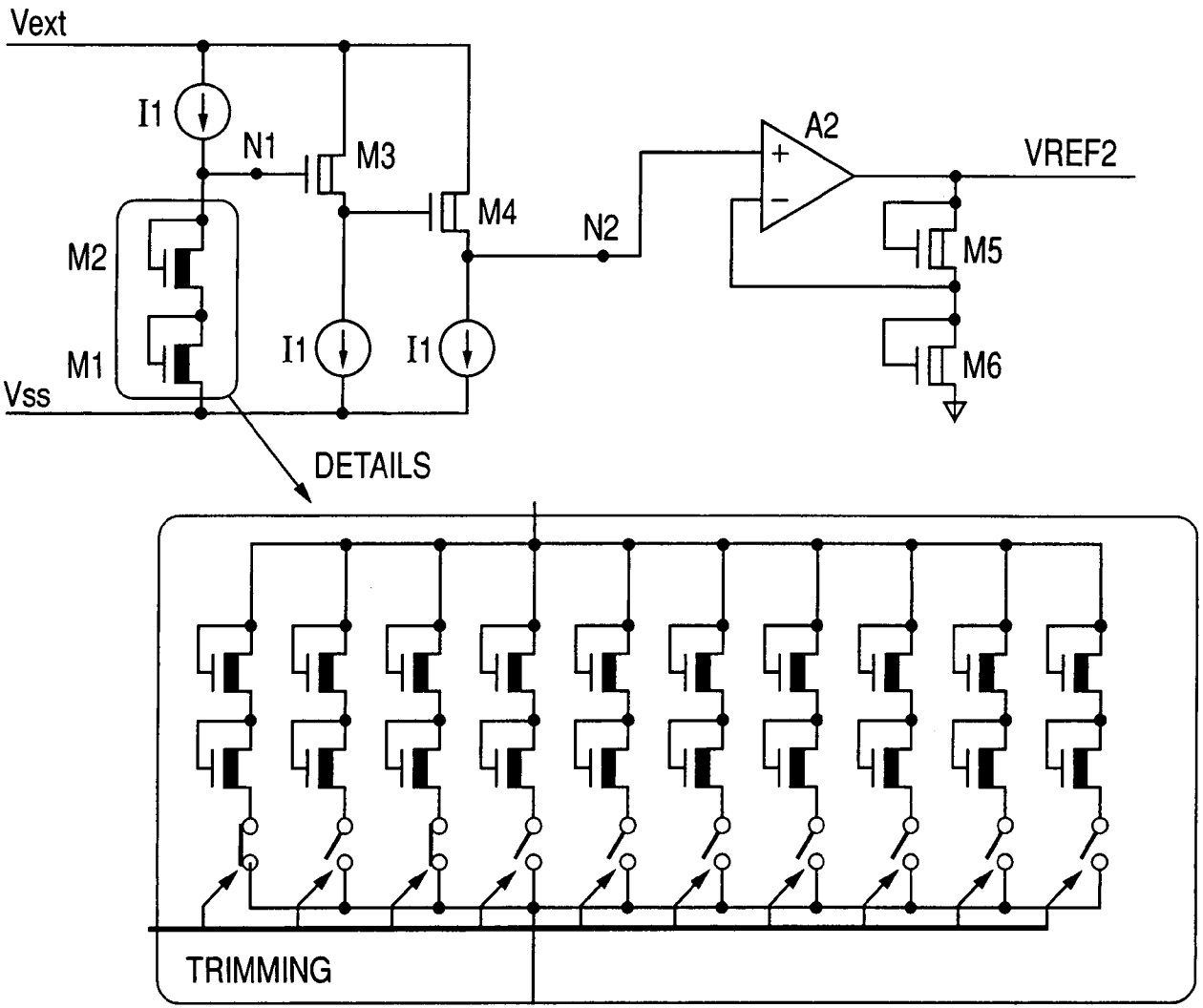
FIG. 7 is a schematic circuit diagram showing an embodiment of the reference voltage 2 generating circuit of FIG. 2.

FIG. 7 illustrates a circuit diagram of an embodiment of the reference voltage 2 generating circuit of FIG. 2. In this embodiment, the control signal enVREF2 in the embodiment of FIG. 2 or the like is eliminated. This embodiment forms the constant voltage 2×VTH corresponding to the threshold voltage VTH by applying a constant current to the diode-connected MOSFETsM1 and M2. This constant voltage 2×VTH is outputted from a source follower circuit consisting of the MOSFETsM3, M4 and the constant current sources provided to the sources thereof, and the output voltage is then amplified with the amplifying circuit A2 to form the reference voltage VREF2.

A serial circuit of the MOSFETsM1 and M2 is formed, as illustrated in the drawing, in the structure in which a plurality of serial circuits consisting of a couple of diode-connected MOSFETs and a switch are provided in parallel. The switch described above is selectively turned ON with a trimming signal. Namely, a plurality of serial circuits, including the serial circuit having the switch in the ON state, are connected in parallel. The MOSFETsM1 and M2 typically indicate the MOSFETs that are connected in parallel with the switch.

The MOSFETsM1 and M2 forming the serial circuit described above are given a threshold value which is larger than that of the MOSFETsM3 to M6 forming the source follower circuit or the like. Although the invention is not particularly so restricted, the MOSFETsM1, M2 are caused to have the threshold voltage VTH1, which is larger than the threshold voltage VTH2 of the MOSFET M3 or the like to which ions are not implanted because ions are implanted to the channel area thereof in order to provide a higher the impurity concentration. Accordingly, the voltage of node N1 in the MOSFETsM1 and M2 is set equal to the voltage 2×VTH1. Since this voltage 2×VTH1 is outputted via the gate and source of the MOSFETsM3, M4, the voltage of node N2 is set to be equal to 2×VTH1−2×VTH2.

As described above, the threshold voltage VTH is used as the reference voltage of the difference voltages of the gate and source voltages VGS of two different kinds of MOSs. In this embodiment, the current value of the constant current source 11, which applies a current to the MOSFET to reduce the power consumption, is set, for example, to a value as low as 100 nA. The bias current of the amplifying circuit A1 is also set to 100 nA. The current flowing into the MOSFETsM5, M6 to set the gain of the amplifying circuit A1 is set to about 200 nA. Accordingly, the current consumption of the reference voltage 2 generating circuit is controlled to about 500 nA.

The MOSFETsM1 and M2 are set depending on the number of MOSFETs connected in parallel, as described above. Namely, when the total width of the MOSFETs connected in parallel is increased to N, the current of 100 nA formed by the constant current source 11 is distributed corresponding to the number of parallel connections, and the current flowing into one serial circuit is reduced to 1/N. Therefore, since the current per unit width of the MOSFETs represented by M1 and M2 is reduced, the gate and source voltage VGS (VTH1) is reduced to lower the voltage 2×VTH1. Accordingly, the voltage (2×VTH1−2×VTH2) of the node N2 is also lowered. Since this voltage is then amplified up to two times the voltage of the amplifying circuit A2 (M5=M6), the reference voltage VREF2 can be adjusted.

This trimming method is essentially based on an adjustment of the current density. In the figure, the current is expressed as the equal current I1, but this trimming is also possible by varying the current of the current source of the MOSFETsM1, M2 and the current of the current source of the MOSFETsM3, M4. In this circuit, the type of MOS (particularly, the gate width W, gate length Lg and allocation) is identical in the MOSFETsM1, M3, M3; and, when the current is totally equal to I1, any difference in the devices can be canceled, resulting in the advantage that the reference voltage can be controlled only with difference of implantation of the MOSFETsM1, M2, M3.

When the width of the MOSFETsM1, M2 is changed to N-times with the trimming, VREF2 can be expressed as 2×2×(VTH1−VTH2−S×log 10(N)) in order to operate, for example, a MOS in the sub-threshold region. Here, S is the sub-threshold swing [V/10 times]. From this formula, it can be understood that the voltage can be adjusted with the trimming, and the influence of the temperature characteristic of sub-threshold swing S is intensified as the voltage deviates further from the condition, N=1.

Figure 8:
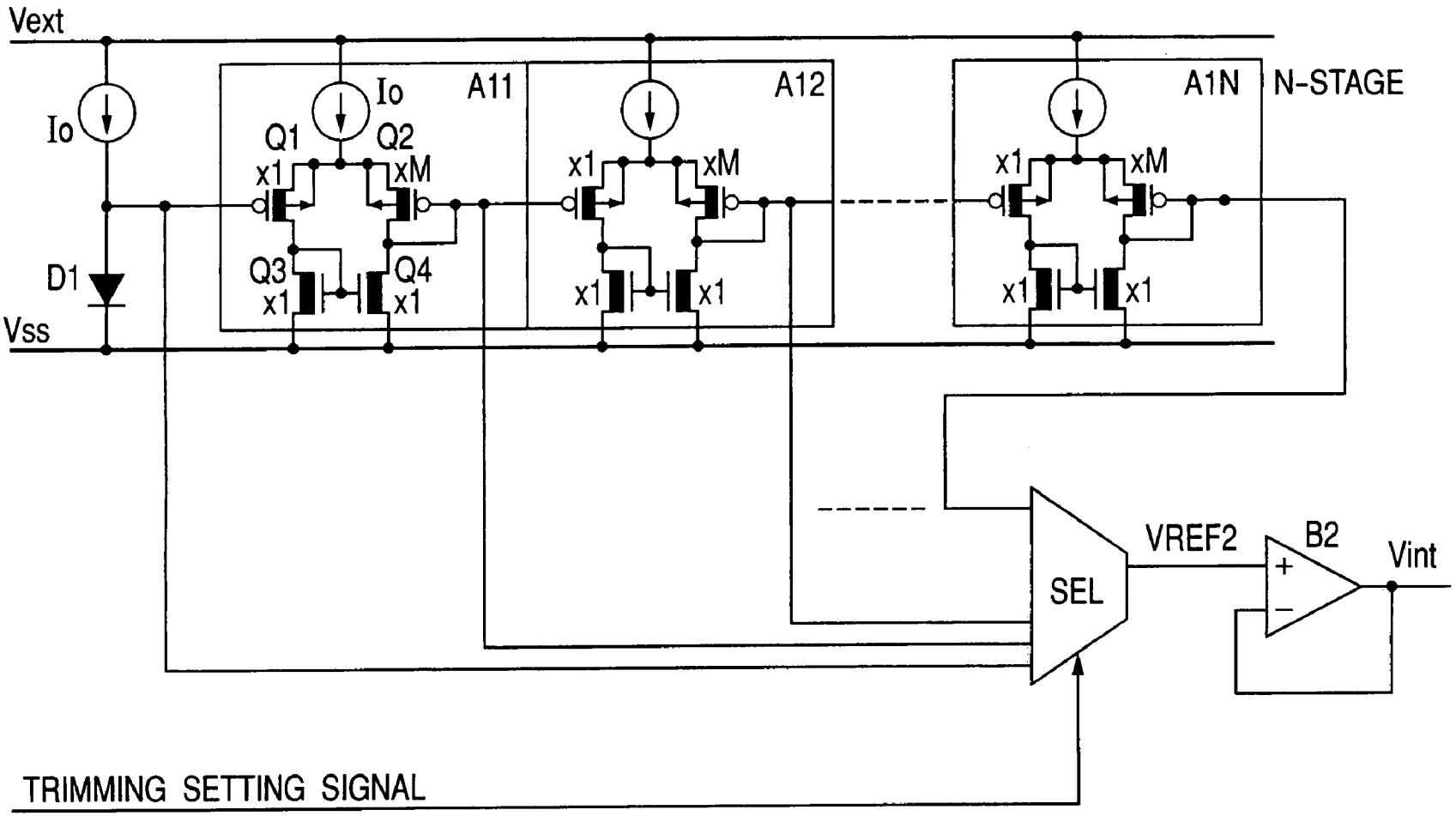
FIG. 8 is a schematic circuit diagram showing another embodiment of the reference voltage 2 generating circuit of FIG. 2.

FIG. 8 illustrates a circuit diagram of another embodiment of the reference voltage 2 generating circuit of FIG. 2. Even in this embodiment, the control signal enVREF2 in the embodiment of FIG. 2 is also eliminated. In this embodiment, temperature compensation can be realized, as well as voltage trimming. In this embodiment, the forward voltage in the forward bias of the PN-junction diode D1 is transferred using a voltage follower circuit of multiple stage connection. The voltage of each stage is selected by the selector SEL, which is controlled by the trimming setting signal, and it is then transferred to the output buffer B2.

In this embodiment, the differential amplifying circuits A11 to A1N forming the voltage follower circuit are respectively formed to provide different widths such as 1:M to the differential MOSFETsQ1 and Q2, as represented by the differential amplifying circuit A11. A current Miller type N-channel load MOSFET provided in the drain side of these differential MOSFETsQ1 and Q2 is set to 1:1 in size and is controlled to apply an equal current to the differential MOSFETsQ1 and Q2. Accordingly, a current density difference is generated in the differential MOSFETsQ1 and Q2, and, thereby, an offset voltage is generated in proportion to the sub-threshold swing S.

Whenever the forward voltage in the forward bias of the diode D1 passes the single stage of the voltage follower circuits A11 to A1N of the multiple stage structure, an offset voltage is accumulated. Therefore, the reference voltage VREF2 of the desired voltage value and temperature characteristic can be extracted by obtaining an output of the desirable number of stages using the selector SEL. Even in this embodiment, for the purpose of low power consumption, a current value of the diode D1 and the constant current source Io provided to the differential amplifying circuits A11 to A1N is set as low as about 50 nA. Accordingly, even when the differential amplifying circuits are provided in many stages, power consumption can be lowered as in the case of FIG. 7.

In this embodiment, since a MOSFET is used to form the reference voltage VREF2 which allows the trimming, the area to be occupied with the voltage step-down power supply circuit for the standby condition can be reduced. For instance, when the voltage step-down power supply circuit for the standby condition is formed with a resistance trimming circuit, like the voltage step-down power supply circuit for the active condition, a resistance value as high as 15 MΩ is required so that only a current as low as about 100 nA is applied by setting the reference voltage VREF2 to 1.5V to realize low power consumption. In order to realize such a high resistance element with a polysilicon resistance element, an occupation area as wide as that required to mount about 50 MOSFETs will be required.

Figure 9:
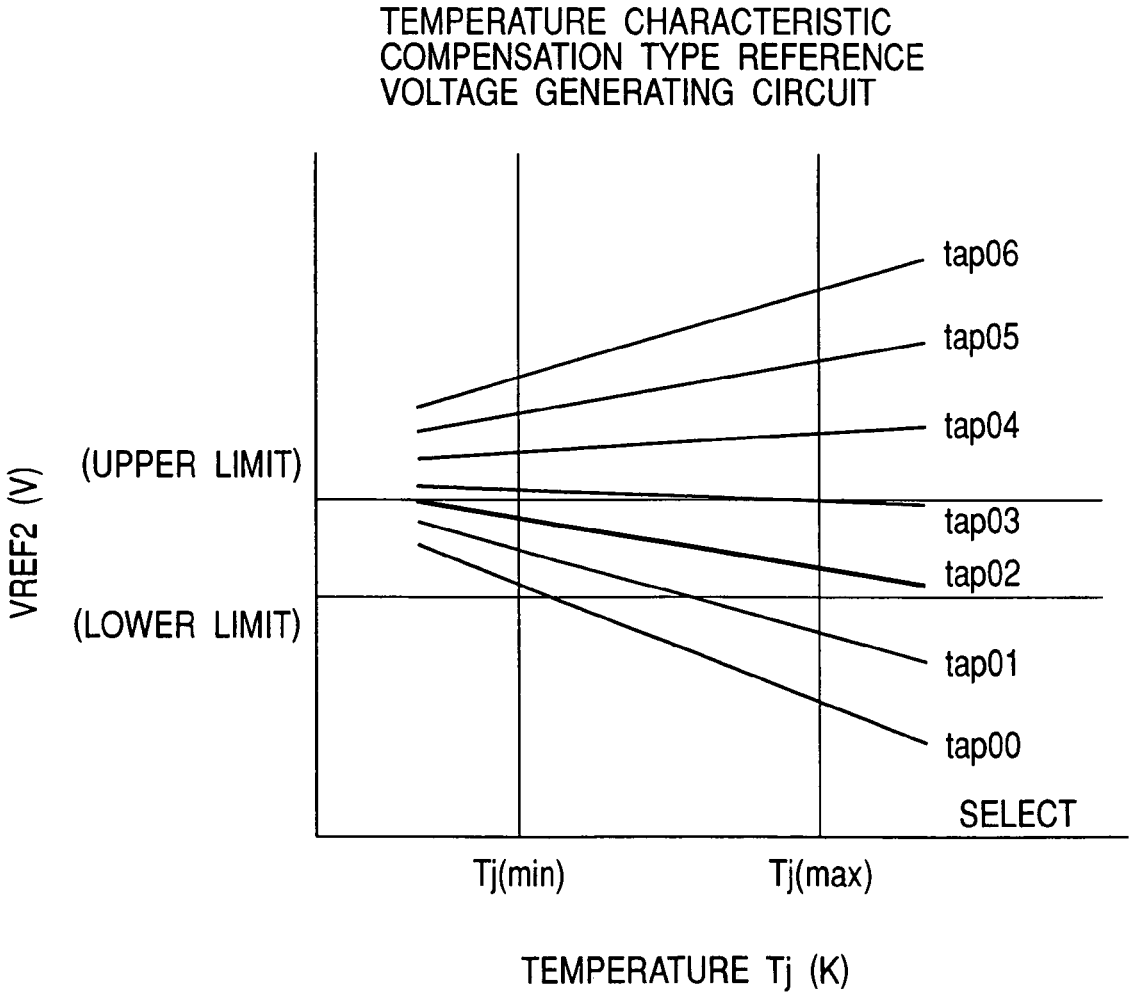
FIG. 9 is a temperature characteristic diagram illustrating the operations of the reference voltage 2 generating circuit of FIG. 8.

FIG. 9 illustrates a temperature characteristic diagram relating to operations of the reference voltage 2 generating circuit of FIG. 8. Since the forward voltage of the PN junction diode D1 has a negative temperature characteristic, as is well known, while the sub-threshold swing S has a positive temperature characteristic, since a larger number of offset voltages are added as the number of taps increases, the temperature characteristic changes to the positive characteristic from the negative characteristic. In the temperature characteristic of FIG. 8, only one characteristic is selected from the characteristic tap00 to tap07 corresponding to a plurality of selection taps, considering the operation environment temperature of the semiconductor integrated circuit device. When priority is given to the temperature characteristic, the characteristic tap03 and the characteristic tap04 are selected. When the voltage range of the reference voltage VREF2 is in the allowable range, a certain dependence on temperature may be left to obtain the desired voltage.

Figure 10:
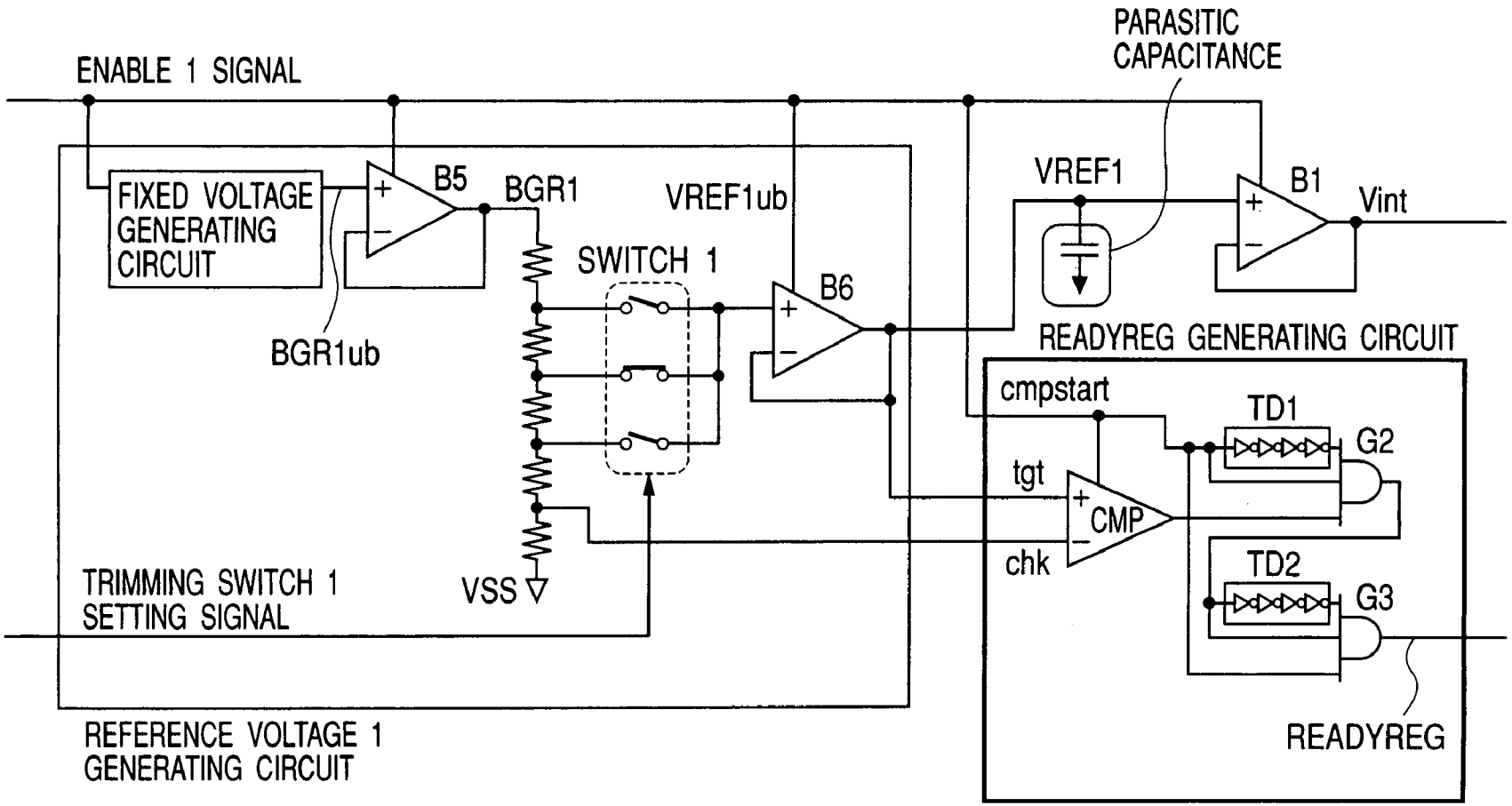
FIG. 10 is a circuit diagram showing another embodiment of a voltage step-down power supply circuit for an active condition in relation to the present invention.

FIG. 10 illustrates a circuit diagram of another embodiment of the voltage step-down power supply circuit for the active condition. In this embodiment, the fixed voltage BGR1*ub* formed in the fixed voltage generating circuit is indicated as a value which is higher than the reference voltage VREF1. The fixed voltage BGR1*ub* formed in the fixed voltage generating circuit is current-amplified with the buffer circuit B5, consisting of the voltage follower circuit, up to the fixed voltage BGR1. This fixed voltage BGR1 is divided by a voltage dividing resistance circuit, and the voltage at each voltage dividing point is selected with the switch 1, which is controlled in the response to the trimming switch 1 setting signal. The divided voltage VREF1*ub* selected by the switch 1 is current-amplified with the buffer circuit B6, consisting of the voltage follower circuit, up to the reference voltage VREF1 and is then outputted as the internal voltage Vint through the output buffer B1.

In this embodiment, since the fixed voltage BGR1 is divided to form the reference voltage VREF1, as described above, the reference voltage VREF1 is supplied as the voltage tat to the non-reversed input (positive) of the comparator CMP of the READYREG generating circuit, while a divided voltage chk, which is lower than the divided voltage for the trimming, is supplied to the reversed input (negative).

The control signal (enable 1) of the voltage step-down power supply circuit for the active condition is supplied, as a start signal (compstart), to the delay circuit TD1, gate circuit G2 and gate circuit G3. With the high level of the signal delayed by the delay circuit TD1 and the high level of the output signal of comparator CMP, an output signal of the gate circuit G2 is set to the high level, and this output signal is delayed again by the delay circuit TD2 so as to output the READYREG signal through the gate circuit G3, which opens the gate with the control signal (enable 1). The reference voltage chk of the comparator CMP rises quicker than a comparison voltage (tgt), but since this signal is raised with the control signal (enable 1 (cmpstart)) and the comparator CMP itself is activated from the non-active condition, the comparison result in the delay time td1 period immediately after the start signal (cmpstart) becomes unstable. Therefore, the comparator output is masked by defining the delay time TD1 as an unstable period. In this embodiment, the time up to unstable operation when the reference voltage 1 generating circuit is started is attained with the time setting of the delay circuits TD1, TD2 described above. The comparator CMP is mainly provided to verify operations of the buffer circuit B6.

Figure 11:
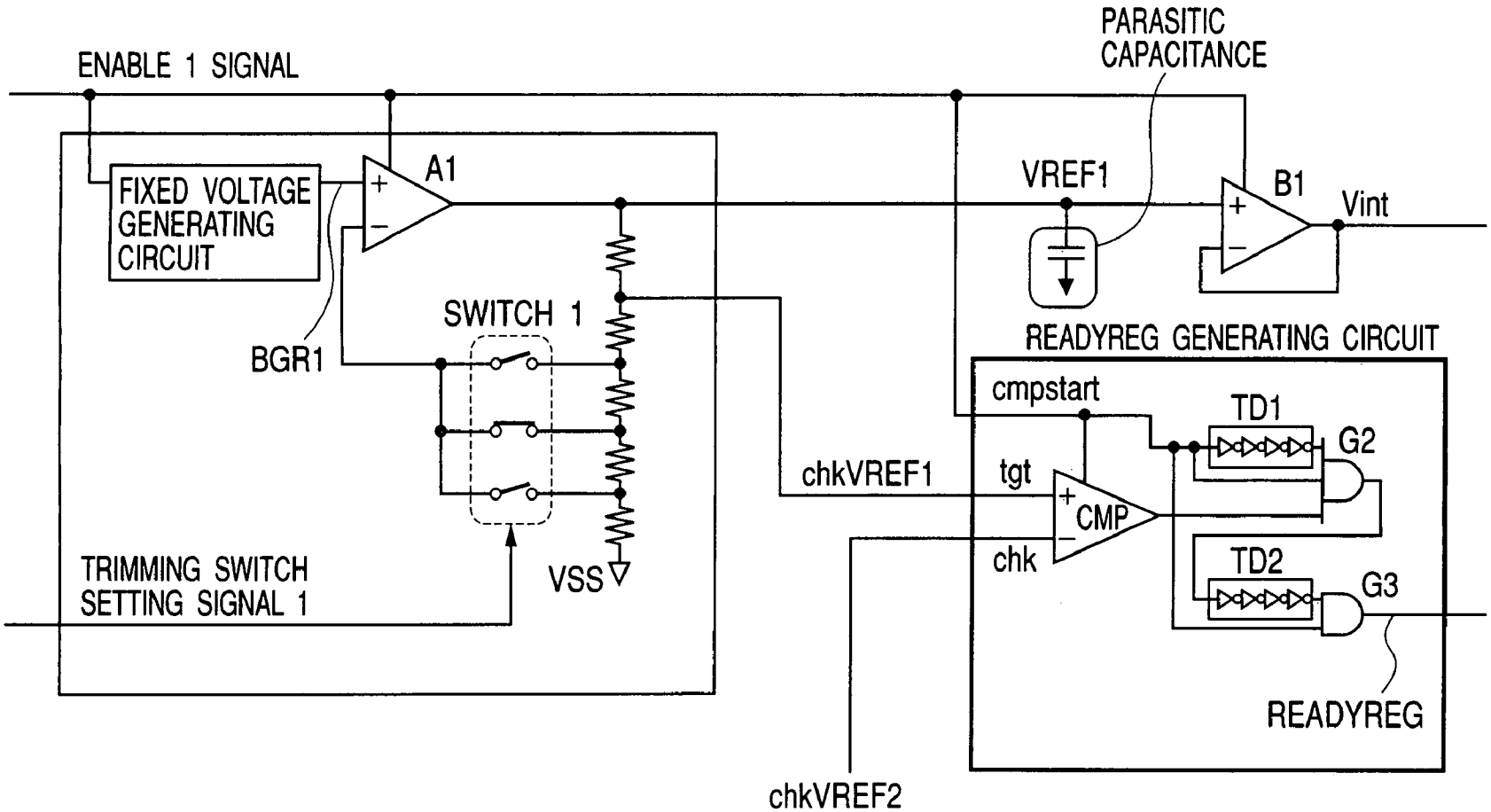
FIG. 11 is a circuit diagram showing another embodiment of the READYREG signal generating circuit provided in the voltage step-down power supply circuit for an active condition in relation to the present invention.

FIG. 11 illustrates a circuit diagram of another embodiment of the READYREG signal generating circuit provided to the voltage step-down power supply circuit for the active condition. The voltage step-down power supply circuit for the active condition according to this embodiment is similar to the embodiment of FIG. 2. In this embodiment, the voltage chkVREF2, which is lower than the normal value of chkVREF1 obtained by adequately dividing the reference voltage VREF2, is used for determination of a rise of the reference voltage VREF1. Namely, since the reference voltage 2 generating circuit of the voltage step-down circuit for the standby condition steadily forms the reference voltage VREF2, the voltage chkVREF2 obtained by dividing such reference voltage steadily maintains the constant voltage level, even in the standby condition and active condition.

Accordingly, since the voltage step-down power supply circuit for the active condition is activated with the control signal (enable 1) and the comparator detects that the divided voltage chkVREF1 exceeds the voltage chkVREF2, a rise of the voltage VREF2 can be determined as illustrated in FIG. 3. The logic circuit for processing the output signal of the comparator CMP is similar to that of FIG. 10. Namely, the comparator CMP compares the tgt voltage with the chk voltage, which is a little lower than the final value, determines when the tgt voltage has exceeded the final value, and thereafter outputs the READYREG signal after waiting for the assumed time TD2 where the voltage reaches the final value. The logic circuit is similar to that of FIG. 10.

Figure 12:
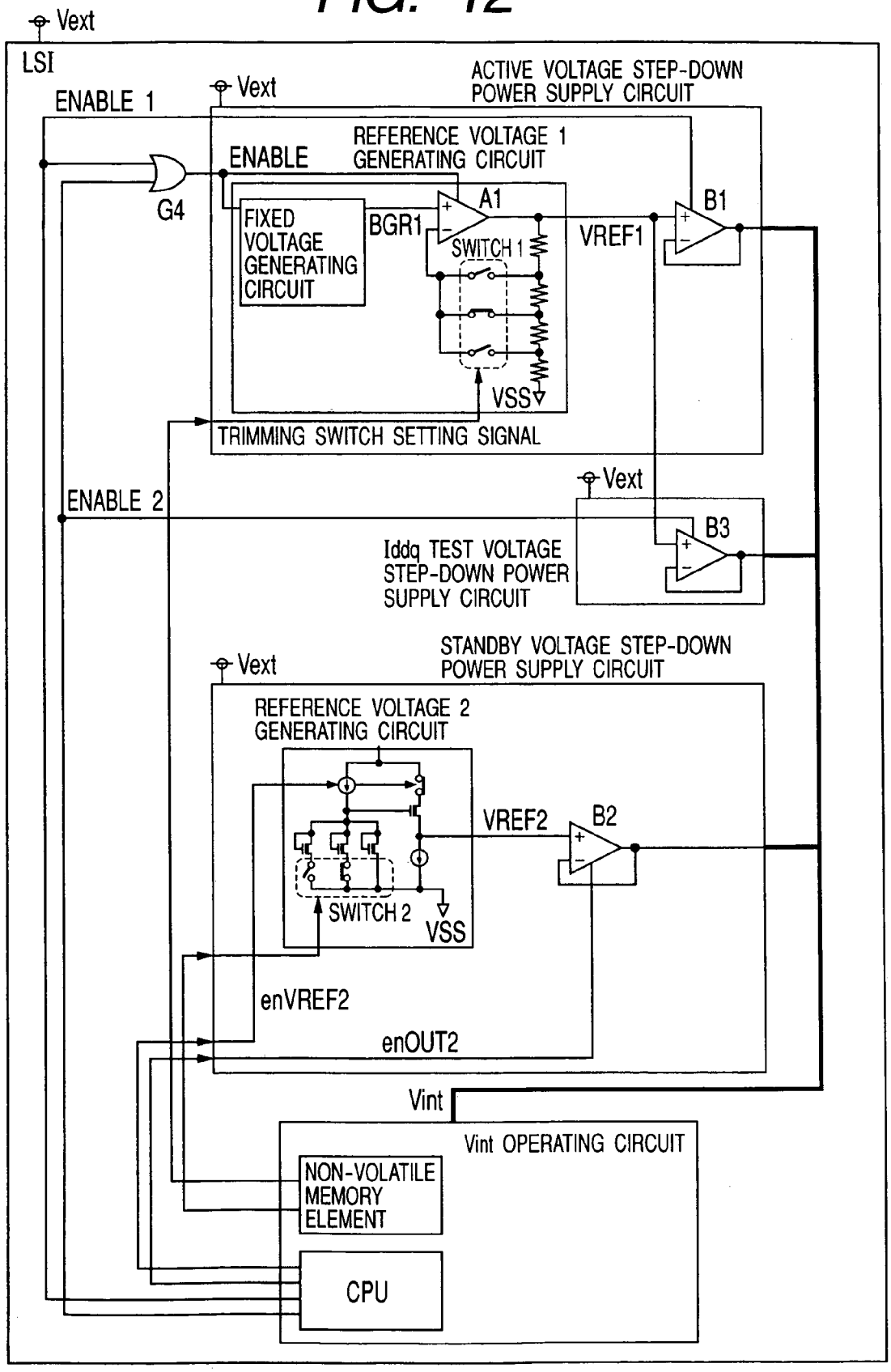
FIG. 12 is a block diagram showing another embodiment of the power supply circuit VG of FIG. 1.

FIG. 12 illustrates a block diagram of another embodiment of the power supply circuit VG of FIG. 1. In this embodiment, a power supply for testing a DC current (iddq) of the semiconductor integrated circuit device is provided.

In the iddq testing, a current flowing from an external terminal Vext of the semiconductor integrated circuit device is measured while the internal circuit is operated slowly to detect poor insulation of the elements and wirings.

The voltage step-down power supply circuit for the active condition is required to have a comparatively large current supplying capability in order to obtain a stable internal voltage Vint, even when the internal circuit is operated in the high speed. Namely, it is required to have the large current supplying capability to provide a stable internal voltage Vint even when the operation current is consumed in the internal circuit, and it is also required that a large current flows into the voltage step-down power supply circuit for the active condition. Accordingly, the current flowing in the voltage step-down power supply circuit for the active condition becomes larger than the leakage current generated by poor insulation in the iddq testing, and, thereby, detection of the leakage current becomes difficult.

In order to solve this problem, a voltage step-down power supply circuit for iddq testing is also provided. This voltage step-down power supply circuit for iddq testing is formed of the output buffer B3 to simplify the circuit. Namely, the internal voltage Vint is formed by inputting the reference voltage VREF1, that is formed by the reference voltage 1 generating circuit, to the output buffer B3. Therefore, the control signal (enable 2) for iddq testing is provided in addition to the control signal (enable 1) for the active condition, and these signals are used to activate the output buffer B3. The reference voltage 1 generating circuit is activated in the active condition and iddq testing is effected in response to the control signal (enable) formed in the OR gate circuit G4, which is connected to receive the control signals (enable 1 and enable 2).

The output buffer B3 can set the operation current to a value which is lower than that of the output buffer B1 because the internal circuit operates slowly during the iddq testing. Accordingly, the current consumed by the voltage step-down power supply circuit can be reduced during iddq testing, and, thereby, the detection accuracy of the leakage current generated due to poor insulation becomes high. If current consumption in the aforementioned reference voltage 1 generating circuit cannot be neglected, it is also possible to stop operation of the voltage step-down power supply circuit for the active condition in the iddq testing mode and to form the internal voltage Vint with the output buffer B3 using the reference voltage VREF2 of the reference voltage 2 generating circuit for the standby condition.

Figure 13:
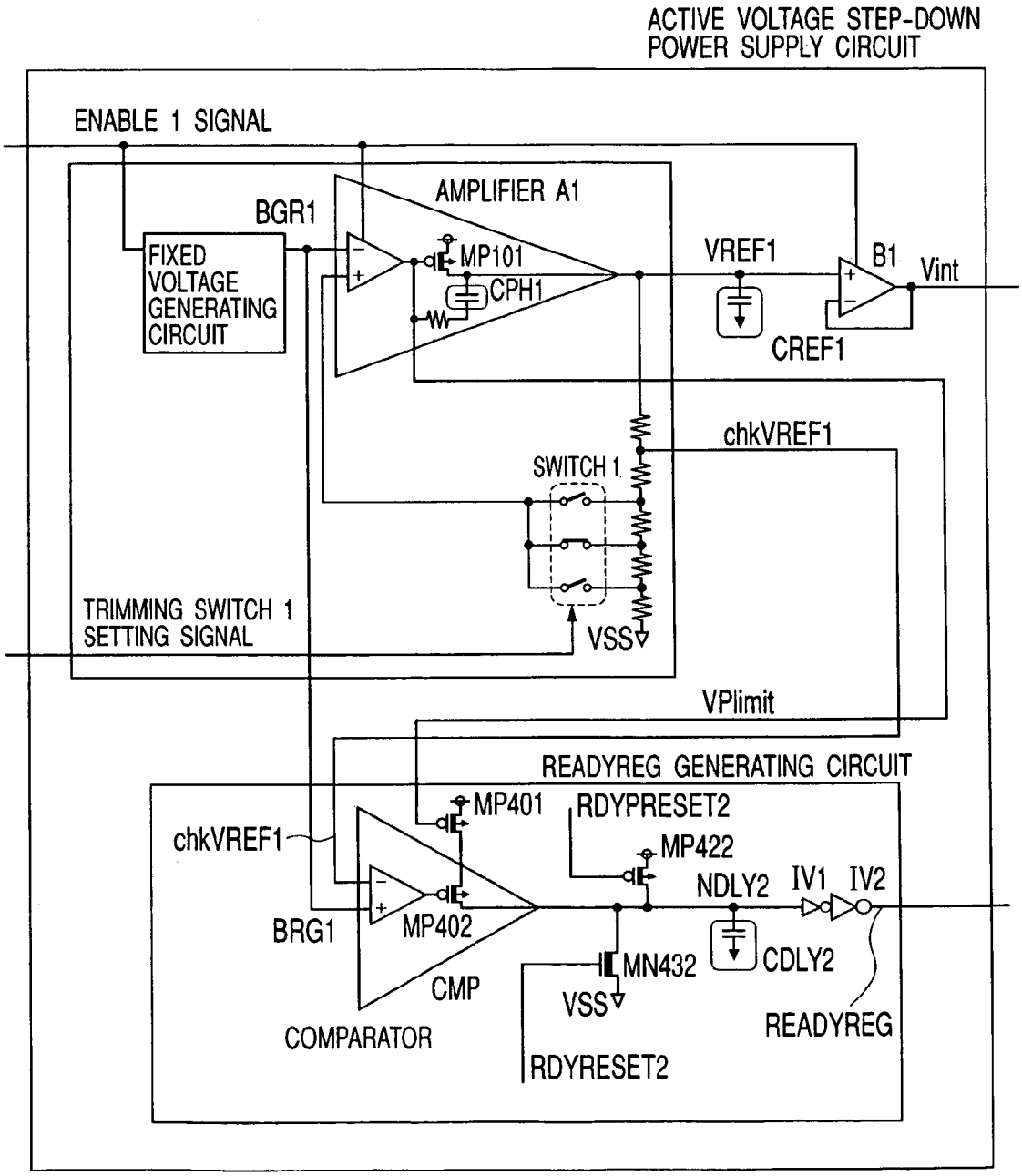
FIG. 13 is a circuit diagram showing another embodiment of the READYREG signal generating circuit provided in the voltage step-down power supply circuit for an active condition in relation to the present invention.

FIG. 13 illustrates a circuit diagram of another embodiment of the READYREG generating circuit provided in the voltage step-down power supply circuit for the active condition. In the amplifier (amplifying circuit) A1 of this embodiment, the output stage MOSFET MP101 of the P channel is provided in the differential amplifying circuit and the gate Vplimit is connected, in the current Miller profile, to the P channel MOSMP 401 for current limitation of the output stage of the READYREG generating circuit. Therefore, the current flowing into a parasitic capacitance CREF1 to form the reference voltage VREF1 corresponds to the current flowing into the comparator CMP for comparing the fixed voltage BGR1 with the divided voltage chkVREF1. A delay capacitance CDLY2 is also provided at the output of the comparator CMP.

The initial value in the standby condition is BGR1=VREF1=NDLY2=READYREG=0V (low level). When the control signal (enable 1) rises, the switch MOSFET MN432 or the like, which has determined the initial value, such as the RDYRESET signal, turns OFF, and the fixed voltage BGR1 of the fixed voltage generating circuit starts to rise. Subsequently, the MOSFET MP101 of the amplifier A1 raises the reference voltage VREF1 while it is charging the capacitances CPH1 and CREF1. When the level of the divided voltage chkVREF1 of the reference voltage VREF1 exceeds the fixed voltage BGR1, the output of the comparator CMP is inverted, the P channel MOSFET MP402 turns ON, and the NDLY2 signal starts to rise.

The current flowing into the node NDLY can be reduced to a small current determined with a Miller ratio (size ratio) because the MOSFET MP101 and MP401, which are supplying the current to the node VREF1, are Miller-connected via the Vplimit. When the NDLY2 signal exceeds the threshold of the inverters IV1, IV2, the READYREG signal becomes high level. Since the current to form the READYREG signal can be reduced to a small current, the delay capacitance CDL2 having small capacitance value (size) may be used.

When the active condition is changed to the standby condition, the RDYRESET2 signal is set to the high level to turn ON the MOSFET MN432 and set the READYREG signal to the low level. The RDYPRESET2 signal becomes low level to turn ON the P channel MOSFET MP422 and forcibly sets the READYREG signal to the high level.

In the description of each embodiment, parts not related to the present invention have been eliminated. For example, considerations to prevent breakdown and to realize recovery for initial values before the trimming, the throwing of the power switch and partial erroneous operation are required in any portion of the chip. Addition or deletion of signals for these portions in the circuit disclosed in the present application is never inhibited.

The present invention has been described above practically based on various embodiments thereof. However, the present invention is never restricted thereto and allows various changes or modifications within a scope not departing from the appended claims. For example, the fixed voltage generating circuit and the reference voltage 1 generating circuit can be provided as various embodiments because there is no limitation on the current consumption. The voltage step-down circuit for the standby condition is sufficient when trimming been be accomplished by utilizing the threshold voltage difference of the MOSFETs. The present invention can be applied to various digital signal processing circuits, including a microprocessor or the like, and also to a semiconductor storage device, such as dynamic RAM and static RAM or the like, including the active mode for the write and read operations and the standby mode for holding the stored information.

The typical features of the present invention can provide the following effects. The semiconductor integrated circuit device exhibits high performance and low power consumption in a smaller area by amplifying a fixed voltage formed in the fixed voltage generating circuit using an amplifying circuit, which can adjust the voltage gain using a resistance circuit and a switch controlled in response to a first trimming switch setting signal, outputting an internal step-down voltage, when the internal circuit is in the active condition, using the first output buffer which is activated by the first control signal, forming a second reference voltage by adjusting a combination of the threshold voltages with a plurality of MOSFETs and a switch controlled by the second trimming switch setting signal, and then outputting an internal step-down voltage when the internal circuit is in the standby condition using the second output buffer, which is activated in response to the second control signal.

What is claimed is:

1. A semiconductor integrated circuit device comprising:

a first voltage generating circuit generating a first voltage;

a first reference voltage generating circuit to form a first reference voltage by use of an amplifying circuit by receiving the first voltage provided by said first voltage generating circuit and adjusting the voltage gain with a resistance circuit and a switch controlled by a first trimming switch setting signal;

a first output buffer which is activated by a first control signal to form an internal voltage corresponding to said first reference voltage;

a second reference voltage generating circuit to form a second reference voltage by adjusting the combination of threshold voltages of MOSFETs, using a plurality of MOSFETs and a switch controlled by a second trimming switch setting signal;

a second output buffer activated with a second control signal to form an internal voltage corresponding to said second reference voltage; and an internal circuit to receive the internal voltage supplied from said first output buffer or said second output buffer activated by said first control signal and said second control signal, respectively;

wherein said internal circuit is set to the active condition by said first control signal when the internal voltage is supplied from said first output buffer and to the standby condition by said second control signal when the internal voltage is supplied from said second output buffer.

2. The semiconductor integrated circuit device according to claim 1, wherein said second reference voltage generating circuit includes: a plurality of serial circuits, each of which is comprised of a plurality of diode type MOSFETs and switches; and a current source circuit provided in common for said plurality of serial circuits, and wherein said second reference voltage is adjusted by controlling said switches with said second trimming setting signal.

3. The semiconductor integrated circuit device according to claim 1, wherein said second reference voltage generating circuit includes: a second voltage circuit to generate a second voltage which is a forward voltage of a PN junction diode; a cascade-connected circuit including a plurality of cascade-connected voltage follower circuits which have an offset voltage with a differential MOSFET which causes currents of different current densities to flow at respective cascade-connecting points; and a selector to select a voltage at one of the cascade-connecting points, and wherein said second voltage is used as an input voltage of an initial stage circuit of said cascade-connected circuit, and said selector is controlled by said second trimming switch setting signal to output a voltage at any one of said cascade-connecting points as said second reference voltage.

4. The semiconductor integrated circuit device according to claim 1, further comprising a third output buffer having a current supply capability that is lower than that of said first output buffer, wherein said third output buffer is set to an operating condition in place of said first output buffer during a DC current testing condition of the semiconductor integrated circuit device.

5. The semiconductor integrated circuit device according to claim 4, wherein said first output buffer is activated by said first control signal, wherein said third output buffer is activated by a third control signal, and wherein said first voltage generating circuit and said first reference voltage generating circuit are activated by a logical sum (OR) signal of said first control signal and said second control signal.

6. The semiconductor integrated circuit device according to claim 1, further comprising a voltage detecting circuit for detecting that an output voltage of said first control signal has reached a predetermined voltage to assure stable operation of said internal circuit, wherein, when the operations of said first first voltage generating circuit, first reference voltage generating circuit and first output buffer are shifted to the active condition from the non-active condition by said first control signal, supply of a clock signal to said internal circuit is started by a detection signal of said voltage detection circuit, and the operation of said second output buffer is shifted to the non-active condition by said second control signal.

7. The semiconductor integrated circuit device according to claim 6, wherein said voltage detecting circuit includes a voltage comparing circuit to compare said first voltage with said first reference voltage and a delay circuit to receive a voltage comparison output signal of said voltage comparing circuit, and said detection signal is formed by delaying, with said delay circuit, the voltage comparison output signal indicating that said first reference voltage becomes higher than said first voltage.

8. The semiconductor integrated circuit device according to claim 1, further comprising a third output buffer which receives said second reference voltage and is activated by a fourth control signal, wherein said fourth control signal activates said third output buffer under the condition that an internal voltage corresponding to said first reference voltage is outputted by said first control signal to change said internal circuit to the operating condition, and said internal circuit forms said second trimming switch setting signal to set the output voltage of said third output buffer to a predetermined voltage and then store this signal to a non-volatile storage circuit included in the internal circuit.

9. The semiconductor integrated circuit device according to claim 8, wherein said internal circuit forms said first trimming switch setting signal so as to set the output voltage of said first output buffer to the predetermined voltage and then stores this signal to said non-volatile storage circuit.

10. The semiconductor integrated circuit according to claim 9, wherein said internal circuit includes a microprocessor, a ROM storing at least a part of the operations of said microprocessor, and the non-volatile storage circuit, and wherein said ROM includes a program to execute an operation to form the first trimming switch setting signal and the second trimming switch setting signal for setting said first reference voltage and he second reference voltage to the predetermined voltage and the operation to store such first and second trimming switch setting signals to said non-volatile storage circuit.

11. The semiconductor integrated circuit device according to claim 9, wherein said internal circuit includes a microprocessor, a ROM storing at least a part of the operations of said microprocessor, and the non-volatile storage circuit, and wherein said ROM includes a function for reading a program for setting said first reference voltage and second reference voltage to the predetermined voltage.

12. A semiconductor integrated circuit device comprising:

a voltage generating circuit to form a first voltage;

a first reference voltage generating circuit including: an amplifying circuit having a first input terminal to receive said first voltage, a second input terminal, and an output terminal; a first resistance connected between said output terminal and said second input terminal; and a second resistance connected between said second input terminal and a second voltage, said first reference voltage generating circuit forming a first reference voltage;

a first output buffer to form an internal voltage corresponding to said first reference voltage;

a second reference voltage generating circuit including: a first MOSFET of diode connection and a current source circuit which are connected in serial between said second voltage and a third voltage; and a second MOSFET having a gate connected to a node between said first MOSFET and said current source circuit and outputting a second reference voltage from the source/drain path thereof;

a second output buffer to form an internal voltage corresponding to said second reference voltage; and an internal circuit to receive the internal voltage supplied from said first output buffer and second output buffer, wherein said internal voltage is supplied from said first output buffer when said internal circuit is in the active condition, and said internal voltage is supplied from said second output buffer when said internal circuit is in the standby condition.

13. A semiconductor integrated circuit device, comprising:

a voltage generating circuit to form a first voltage;

a first reference voltage generating circuit including: an amplifying circuit having a first input terminal to receive said first voltage, a second input terminal, and an output terminal; a first resistance connected between said output terminal and said second input terminal; and a second resistance connected between said second input terminal and a second voltage, said first reference voltage generating circuit forming a first reference voltage;

a second reference voltage generating circuit including: a first MOSFET of diode connection and a current source circuit which are connected in serial; and a second MOSFET having a gate connected to a node between said first MOSFET and said current source circuit and outputting said second reference voltage from the source/drain path thereof; and an internal circuit to operate with an internal voltage, wherein said internal voltage is formed based on said first reference voltage and said second reference voltage, wherein said first reference voltage generating circuit is in the active condition when said internal circuit is in the active condition, and wherein said first reference voltage generating circuit is in the non-active condition and said second reference voltage generating circuit is in the active condition when said internal circuit is in the standby condition.

14. A semiconductor integrated circuit device comprising:

a first reference voltage generating circuit receiving a first voltage and including an amplifying circuit having a resistance circuit and a switch controlled by a first trimming switch setting signal, to form a first reference voltage;

a second reference voltage generating circuit including a plurality of MOSFETs and a switch controlled by a second trimming switch setting signal, to form a second reference voltage; and an internal circuit to operate by receiving an internal voltage;

wherein said internal voltage is formed based on said first reference voltage or said second reference voltage, wherein said first reference voltage generating circuit is in the active condition when said internal circuit is in the active condition, and wherein said first reference voltage generating circuit is in the non-active condition and said second reference voltage generating circuit is in the active condition when said internal circuit is in the standby condition.

15. A semiconductor integrated circuit device according to claim 1, wherein said first voltage is a fixed voltage.

16. A semiconductor integrated circuit device according to claim 3, wherein said second voltage is a constant voltage.

* * * * *

UNITED STATES PATENT AND TRADEMARK OFFICE

CERTIFICATE OF CORRECTION

PATENT NO. : 7,049,797 B2
APPLICATION NO. : 10/676605
DATED : May 23, 2006
INVENTOR(S) : K. Kukui et al.

It is certified that error appears in the above-identified patent and that said Letters Patent is hereby corrected as shown below:

Col. 16, the end of claim 5 line 10 please change "second control signal" to --third control signal--.

Signed and Sealed this

Tenth Day of June, 2008

JON W. DUDAS
*Director of the United States Patent and Trademark Office*